United States Patent [19]

Kuwabara et al.

[11] Patent Number: 4,469,783

[45] Date of Patent: Sep. 4, 1984

[54] SILVER HALIDE PHOTOGRAPHIC EMULSIONS

[75] Inventors: Kenichi Kuwabara; Satoshi Kubota; Hiroyuki Mifune, all of Kanagawa, Japan

[73] Assignee: Fuji Photo Film Co., Ltd., Kanagawa, Japan

[21] Appl. No.: 500,707

[22] Filed: Jun. 3, 1983

[30] Foreign Application Priority Data

Jun. 4, 1982 [JP] Japan ..... 57-95796

[51] Int. Cl.[3] ..... G03C 1/02; G03C 1/06

[52] U.S. Cl. ..... 430/567; 430/569; 430/600; 430/603; 430/605

[58] Field of Search ..... 430/567, 569, 607, 604, 430/611, 614, 600, 603, 605

[56] References Cited

U.S. PATENT DOCUMENTS 3,615,579 10/1971 Bigelow ..... 430/569
3,901,713 8/1975 Yamasue et al. ..... 430/569
4,269,927 5/1981 Atwell ..... 430/604
4,284,717 8/1981 Toya et al. ..... 430/603
4,288,535 9/1981 Kanisawa et al. ..... 430/569

*Primary Examiner*—Mary F. Downey
*Attorney, Agent, or Firm*—Sughrue, Mion, Zinn, Macpeak and Seas

[57] ABSTRACT

A silver halide photographic emulsion is described, which has halogen composition comprises at least 60 mole % of silver chloride, 40 mole % or less of silver bromide, and 5 mole % or less of silver bromide. Grain formation is performed in the presence of a silver halide solvent selected from the group consisting of tetrasubstituted thioureas and organic thioethers, and from $10^{-8}$ to $10^{-5}$ mole of a water-soluble iridium compound per mole of silver halide. This photographic emulsion exhibits high sensitivity and provides high contrast even by flash exposure. Thus, it is useful for the production of light-sensitive materials to be used in the production of printing plates in accordance with photographic engraving.

4 Claims, No Drawings

SILVER HALIDE PHOTOGRAPHIC EMULSIONS

FIELD OF THE INVENTION

The present invention relates to silver halide photographic emulsions which are of high sensitivity and provide high contrast. More particularly, the present invention relates to silver halide photographic emulsions which exhibit high sensitivity and provide high contrast when exposed to light at high illumination for a short period of time (this exposing process is hereinafter referred to as "flash exposure").

BACKGROUND OF THE INVENTION

In accordance with a photographic engraving process employed in the field of print duplication, a photographic image having a continuous gradation is converted into a so-called dot image in which the density of the image is represented by the size of the dot area. This dot image is used in combination with an original consisting of letters and lines to produce a printing plate.

Production of printed matter having an excellent finishing quality requires the use of a printing plate having a line/dot image of high quality. For this reason, a light-sensitive material for use in the production of the line/dot image must have the photographic characteristics needed to provide an image of high contrast, i.e., in which image and non-image areas are clearly distinguishable, and of high blackening density. In order to meet these requirements, various light-sensitive materials, such as a so-called lith type silver halide light-sensitive material, have been developed.

Recently, as a method of forming a dot image, a process using a scanner, for example, a direct scanner process and a dot generator process, has been rapidly developed. In such image duplication or conversion processes using a scanner, a light-sensitive material is exposed and recorded by a scanning light beam or laser beam from, e.g., a xenon flash lamp, an argon laser source, a helium-neon laser source, and a light emitting diode, at a very high speed.

During this exposure with a scanner, the light beam is only applied onto one point of the light-sensitive material for a very short period of time of from $10^{-4}$ to $10^{-7}$ second; i.e., it is flash exposure. Accordingly, the light-sensitive material must exhibit high sensitivity to the scanned light beam, and provides high contrast in response to even the high-speed flash exposure.

In order to provide silver halide photographic emulsions with high sensitivity to light having a specific spectral energy, so-called spectral sensitization is usually applied. However, when using flash exposure of silver halide photographic emulsions, a phenomenon called "high intensity reciprocity law failure" usually occurs; i.e., sensitivity and contrast are reduced. If the sensitivity and contrast have been reduced by the high intensity reciprocity law failure, it is difficult to obtain good line originals and high dot quality.

It has therefore been the subject of a long and continuing investigation by those engaged in the art to overcome the above-described problems.

Several methods have been developed to produce silver halide photographic emulsions in which there is less occurrence of the high intensity reciprocity law failure, and which have high sensitivity and provide high contrast even by flash exposure. For example, as described in Japanese Patent Publication Nos. 4935/68, 32738/70, 33781/74, Japanese Patent Application (OPI) Nos. 6725/73 (which corresponds to U.S. Pat. No. 3,901,713), and 166637/80, a method is known in which iridium compounds are added alone or in combination with additives such as rhodium salts and iodides at the time of emulsification or first ripening of silver halide. These conventional methods, however, are not sufficiently satisfactory.

It is also known that the production of a silver halide emulsion having a uniform grain size by adding silver halide solvents at the time of formation of grain leads to an increase in contrast. With these emulsions, however, there is inevitably a reduction in contrast when using flash exposure.

Light-sensitive materials to be used in the production of printing plates are usually handled or touched with the hands and, therefore, pressure, e.g., bending, is often applied thereon. On application of pressure, the light-sensitive materials are easily sensitized or desensitized at the areas where pressure is applied. It has therefore been desired to develop photographic emulsions which are insensitive or less sensitive to pressure.

SUMMARY OF THE INVENTION

An object of the invention is to provide silver halide photographic emulsions which are highly sensitive and provide high contrast in response to flash exposure.

Another object of the invention is to provide silver halide photographic emulsions suitable for use in the production of light-sensitive materials for photographic engraving, which at flash exposure, exhibit high sensitivity and provide high contrast, and produce excellent line originals and dot quality.

Still another object of the invention is to provide silver halide photographic emulsions which permit the production of light-sensitive materials which are insensitive or less sensitive to pressure.

It has been found that the objects can be attained by growing the grains of a silver halide emulsion in such a manner that they are comprised of least 60 mol% of silver chloride, 40 mole% or less of silver bromide, and 5 mol% or less of silver iodide. The grain are produced in the presence of a silver halide solvent and a water-soluble iridium compound, said silver halide solvent being selected from the group consisting of tetra-substituted thioureas and organic thioethers, and said water-soluble iridium compound being added in an amount of from $10^{-8}$ to $10^{-5}$ mole per mole of silver halide.

The present invention relates to a silver halide photographic emulsion having the silver halide grains comprising at least 60 mole% of silver chloride, 40 mole% of less of silver bromide, and 5 mole% or less of silver iodide, wherein the growth of grain is carried out in the presence of a silver halide solvent selected from the group consisting of tetra-substituted thioureas and organic thioethers, and from $10^{-8}$ to $10^{-5}$ mole per mole of silver halide of a water-soluble iridium compound.

DETAILED DESCRIPTION OF THE INVENTION

The silver halide solvent and water-soluble iridium compound are added at any suitable step during the process of grain growth, i.e., before the silver halide grains take their final size and shape. In the invention, it is preferred that the silver halide solvent and water-soluble iridium compound are added prior to the physical ripening of the silver halide.

The silver halide solvent and water-soluble iridium compound are added to, for example, a colloidal substance in which silver halide is to be precipitated. They are added in combination with any of water-soluble salts, such as water-soluble silver salts (e.g., silver nitrate), and water-soluble halides (e.g., alkali metal halides such as potassium bromide and sodium chloride), which are used to prepare silver halide.

The silver halide solvent and water-soluble iridium compound may be added at the same time or separately. For example, there may be employed a procedure in which the silver halide solvent is added to an aqueous solution of the colloidal substance in which silver halide is to be precipitated, and a halogen salt-containing aqueous solution containing the water-soluble iridium compound is added to the above-prepared aqueous solution.

The emulsion of the invention can be prepared by the methods described in, for example, P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964).

The water-soluble silver salt and water-soluble halide can be reacted in any suitable manner, e.g., by a single jet method, a double jet method, and a combination thereof. A method (so-called reversal jet method) in which grains are formed in the presence of an excess of silver ions can be used. In addition, a method (so-called controlled double jet method) in which pAg in a liquid phase where silver halide is formed is maintained at a constant level, which is one type of the double jet method, can be used. Particularly preferred method is the controlled double jet method.

Although conditions under which the emulsion of the invention is produced are not critical, it is generally preferred that the temperature is from about 30° to 90° C., the pH is up to about 9, with the range of 8 or less being particularly preferred, and that the pAg is up to about 10.

Tetra-substituted thiourea silver halide solvents which are preferably used in the invention include the compounds, as described in, for example, Japanese Patent Application (OPI) Nos. 82408/78 and 77737/80 (the term "OPI" as used herein means a "published unexamined Japanese patent application"), represented by the following general formula:

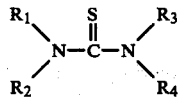

wherein $R_1$, $R_2$, $R_3$ and $R_4$ may be the same or different, and are each a substituted or unsubstituted alkyl group, an alkenyl group (e.g., an allyl group), or a substituted or unsubstituted aryl group. The total number of carbon atoms contained in $R_1$ to $R_4$ is preferably 30 or less. $R_1$ and $R_2$, $R_2$ and $R_3$, or $R_3$ and $R_4$ may combine together to form a 5- or 6-membered heterocyclic ring, such as imidazolidinethione, piperidine, or morpholine. The above-described alkyl group may be straight or branched.

Substituents of the substituted alkyl groups include a hydroxyl group (—OH), a carboxyl group, a sulfonic acid group, an amino group, an alkoxy group (—O—alkyl) having an alkyl moiety containing from 1 to 5 carbon atoms, a phenyl group, and a 5- or 6-membered heterocyclic ring (e.g., furan). Substituents of the substituted aryl groups include a hydroxyl group, a carboxyl group, and a sulfonic acid group.

It is particularly preferred that three of more of $R_1$ to $R_4$ are alkyl groups, the number of carbon atoms in each alkyl group is from 1 to 5, the aryl group is a phenyl group, and that the total number of carbon atoms in $R_1$ to $R_4$ is 20 or less.

Preferred examples of the compounds that can be used in the invention are shown below:

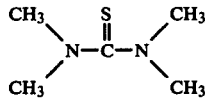
(1)

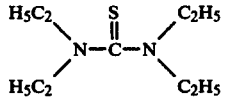
(2)

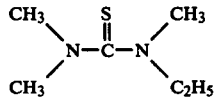
(3)

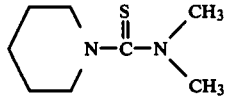
(4)

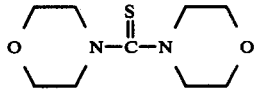
(5)

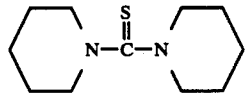
(6)

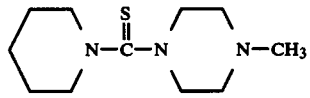
(7)

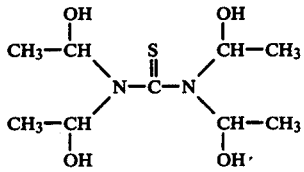
(8)

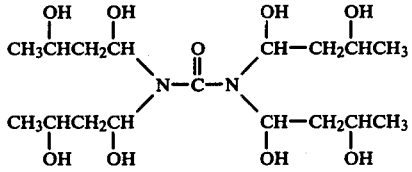
(9)

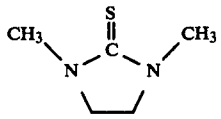
(10)

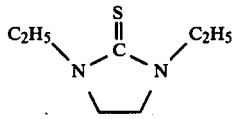
(11)

-continued (12)

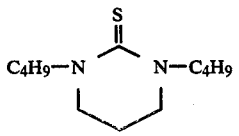

(13)

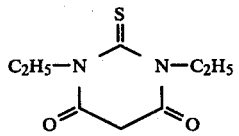

(14)

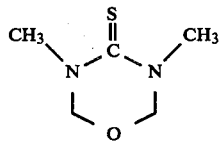

(15)

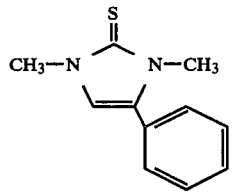

(16)

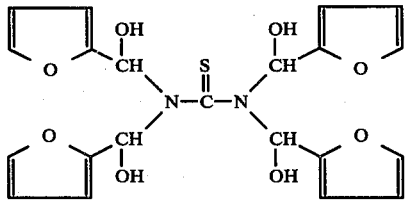

Particularly preferred examples of the compounds that can be used in the present invention include Compounds (1) to (4) and (10) to (12).

Methods of preparation of the above-described compounds are described in, for example, J. Braun & K. Weizbach, *Berichte der Deutschen Chemischen Gesellschaft,* 63, 2846 (1930), V. Mozolis & S. Jokubaityte, *Lietuvos T S R Mokslu Akademijos Darbai, Ser. B,* 1969 (3), 125-31, H. Weidlinger & H. Eillingsfeld, West German Patent 1,119,843, R. A. Donia et al., *Journal of Organic Chemistry,* 14, 946-951 (1949), F. B. Zienty, *Journal of American Chemical Society,* 68, 1388-1389 (1946), and L. G. S. Brooker et al., *Journal of American Chemical Society,* 73, 5329-5332 (1951).

Organic thioether silver halide solvents which are preferably used in the invention include compounds containing at least one group (e.g., —O—$CH_2CH_2$—S—) in which oxygen and sulfur atoms are spaced apart by ethylene, as described in Japanese Patent Publication No. 11386/72 (corresponding to U.S. Pat. No. 3,574,628), etc., and chainlike thioether compounds containing alkyl groups at the both terminals thereof, said alkyl group having at least two substituents selected from the group consisting of a hydroxyl group, an amino group, a carboxyl group, an amido group, and a sulfon group, as described in Japanese Patent Application (OPI) No. 155828/79 (corresponding to U.S. Pat. No. 4,276,374).

Preferred examples are shown below:

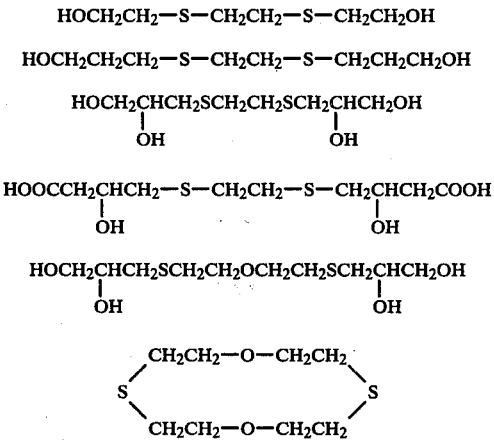

The amount of the silver halide solvent being added is preferably from $10^{-5}$ to 10−2 mole per mole of silver halide, particularly from $5\times10^{-5}$ to $5\times10^{-3}$ mol per mol of silver halide although it varies depending on the type of the solvent, the desired grain size, the halogen composition, and so forth.

When the use of such silver halide solvents results in the production of grains having a grain size exceeding a predetermined or desired level, the desired grain size can be obtained by changing the temperature at which grains are formed, the time of addition of the silver salt solution or halogen salt solution, and so forth.

When used in combination with the iridium compound of the invention, the silver halide solvent produces a specific effect, which is superior to that when used in combination with other silver halide solvents. When ammonia is used as the silver halide solvent, the objects of the invention are not attained. Particularly preferred silver halide solvents are tetra-substituted thioureas.

The iridium compounds used herein include water-soluble iridium salts and iridium complex salts. Preferred examples include iridium trichloride, iridium tetrachloride, potassium hexachloroiridate (III), potassium hexachloroiridate (IV), and ammonium hexachloroiridate (III). The amount of the iridium compound added is appropriately from $10^{-8}$ to $10^{-5}$ mole per mole of silver halide and particularly from $10^{-8}$ to $10^{-5}$ mol per mol of silver halide. If the compounds are added in amounts less than the lower limit no sufficient effect can be obtained. On the other hand, if they are added in greater amounts than $10^{-5}$ mole, desensitization is increased, and the object of the invention cannot be attained.

The halogen composition of the silver halide grains in the emulsion of the invention contains at least 60 mole% of silver chloride, 40 mole% or less of silver bromide, and 5 mole% or less of silver iodide. Silver chlorobromide, and silver chlorobromoiodide are preferred. Those having the other halogen compositions cannot provide excellent line originals and dot quality.

The shape of the silver halide grain may be regular, such as cubic and octahedron, and additionally, it may take a mixed crystal shape. The emulsion preferably has a relatively narrow size distribution in which the mean grain size is within the range of from 0.2 to 0.6 μ. When the grain size is too small, the sensitivity is low, and no excellent line original and dot quality can be obtained.

Also, excessively large grain sizes reduce the maximum density.

During formation or physical ripening of silver halide grains, various heavy metals, for example, rhodium salts as described in Japanese Patent Application (OPI) No. 6725/73 (which corresponds to U.S. Pat. No. 3,901,713) may be present in an amount of $10^{-8}$ to $10^{-6}$ mol per mol of silver halide.

To the thus-formed silver halide grains, usually after removal of by-produced water-soluble salts, various types of chemical sensitization are preferably applied for the purpose of increasing sensitivity. These chemical sensitization methods include sulfur sensitization, reduction sensitization, and noble metal (e.g., gold) sensitization. They can be used alone or in combination with each other.

In order to provide high sensitivity to light used as a light source, spectral sensitization and super color sensitization may be applied using cyanine dyes, such as cyanin, merocyanin, and carbocyanin, alone or in combination with each other.

For the purpose of preventing a reduction in sensititivity or fog formation in the course of production of the light-sensitive material or during the storage thereof, various compounds called stabilizers may be added to the photographic emulsion.

In order to provide line/dot originals of higher contrast by a processing using a lith developer which is commonly used in the field of photographic engraving, compounds containing polyalkyleneoxide can be added.

In addition, in order to provide essential characteristics required for light-sensitive material, various additives, such as film-improving agents, hardeners, antistatic agents, extenders, development accelerators, and development inhibitors, can be added.

As a support on which the photographic emulsion is coated, known supports, such as a polyethylene terephthalate film, a polycarbonate film, a cellulose acetate film, and a polystyrene film, can be used.

The light-sensitive layer of the silver halide emulsion may be of a one-layer structure or of a multilayer structure, and a protective layer may be provided.

The light-sensitive material prepared using the silver halide photographic emulsion of the invention can be processed by conventional developing methods. It is particularly preferred to use a lith developer and an unlith developer which are used in the field of photographic engraving. Processing using such developers produces good results.

The present invention is described in greater detail by reference to the following Examples and comparative Examples. However, the invention is not limited to these examples.

EXAMPLE 1

First, the following solutions (A), (B), and (C) were prepared:

Solution (A)
- Water: 400 ml
- Gelatin: 15 g
- Tetra-substituted thiourea/Compound (1) (1% aqueous solution): 2 ml Solution (B)
- Water: 500 ml
- $AgNO_3$: 100 g Solution (C)
- Water: 500 ml
- KBr: 18 g
- NaCl: 30 g
- $K_3IrCl_6$ (0.01%): 3 ml Solution (B) and (C) were added simultaneously to Solution (A) while maintaining the temperature of Solution (A) at a predetermined level and stirring over a period of 10 minutes to prepare an emulsion. The thus-prepared silver chlorobromide grains had a means grain diameter of 0.30μ and were uniform in size.

After the addition was completed, cooling and desalting were carried out, and 25 g of gelatin was added to make a total volume of 500 ml.

Gold and sulfur sensitizations were applied, and chemical ripening was performed at 60° C. for 60 minutes.

As a stabilizer, 4-hydroxy-6-methyl-1,3,3a,7-tetrazaindene was added. Furthermore, mucochloric acid was added as a hardener, and saponin as an extender.

The thus-prepared emulsion was coated on a polyethylene terephthalate support in such a manner that the amount of silver coated was 4 g/m$^2$. In addition, a gelatin layer was provided as a protective layer to produce a light-sensitive material, Sample (1).

In the same manner as above except that the composition of Solution A was changed as follows:
- Water: 400 ml
- Gelatin: 15 g
- Tetra-substituted thiourea/Compound (4) (1% aqueous solution): 2.5 ml a light-sensitive material, Sample (2), was produced.

EXAMPLE 2

Grain formation was performed in the same manner as in Example 1 except that 5 ml of a 1% aqueous solution of an organic thioether compound represented by the formula:

$$HOC_2H_4SC_2H_4SC_2H_4OH$$

was added in place of the tetra-substituted thiourea compound, Compound (1). The mean grain diameter of the thus-prepared silver halide was 0.30μ.

Thereafter, in the same manner as in Example 1, a light-sensitive material, Sample (3), was produced.

COMPARATIVE EXAMPLE 1

The same Solutions (A), (B), and (C) as in Example 1 except that the thiourea compound, Compound (1), was removed were prepared. Using these Solutions (A), (B) and (C), grain formation was performed while maintaining an elevated addition temperature so that the mean grain diameter reached 0.30μ.

Thereafter, in the same manner as in Example 1, a comparative light-sensitive material, Sample (4), was produced.

COMPARATIVE EXAMPLE 2

A comparative light-sensitive material, Sample (5), was produced in the same manner as in Example 1 except that $K_3IrCl_6$ was removed.

COMPARATIVE EXAMPLE 3

A comparative light-sensitive material, Sample (6), was produced in the same manner as in Example 1 except that both the thiourea compound, Compound (1), and $K_3IrCl_6$ were removed.

The thus-produced light-sensitive materials were each subjected to flash exposure for $10^{-5}$ second through an optical wedge by the use of a xenon flash lamp, developed with Developer (I) having the formulation as described hereinafter, and thereafter, fixed, rinsed with water, and dried in the usual manner. The density was then measured.

Developer (I)

Sodium carbonate (monohydrate): 11 g
Potassium bromide: 3 g
Hydroquinone: 23 g
1-Phenyl-3-pyrazolidone: 0.4 g
Sodium sulfite: 67 g
Potassium hydroxide: 11 g
Water to make: 1 liter The results are shown in Table 1 below.

TABLE 1

| | 38° C., 20" Processing with Developer (I) | | |
|---|---|---|---|
| Run No. | Relative Sensitivity (fog + 1.5) | Straight Portion γ | Pressure Characteristics |
| Sample (1) | 270 | 5.0 | 5 |
| Sample (2) | 268 | 4.8 | 5 |
| Sample (3) | 229 | 4.6 | 4 |
| Sample (4) | 214 | 4.3 | 3 |
| Sample (5) | 138 | 3.8 | 1 |
| Sample (6) | 100 | 3.5 | 1 |

Samples (4) to (6): Comparative light-sensitive materials

The relative sensitivity is shown with that of Sample (6), a comparative light-sensitive material, as 100.

In determining the pressure characteristics, each light-sensitive material was bent at an angle of 30° and, thereafter, exposed to light and developed. The pressure characteristics were evaluated in five stages; "5" indicates that the extent to which the light-sensitive material is influenced by pressure is the lowest, and "1" indicates that the extent of influence is the largest.

The results of Table 1 demonstrates that Sample (3) of Example 2 in which the organic thioether is used is superior to Samples (4) to (6), comparative light-sensitive materials, but that Samples (1) and (2) of Example 1 in which the tetra-substituted thiourea compounds are used exhibit much higher sensitivity and contrast, and excellent pressure characteristics.

EXAMPLE 3

The following solutions (A), (B), and (C) were prepared.

Solution (A)
Water: 400 ml
Gelatin: 15 g
Tetra-substituted thiourea/Compound (10) (1% aqueous solution): 5 ml Solution (B)
Water: 500 ml
$AgNO_3$: 100 g Solution (C)
Water: 500 ml
KBr: 11 g
NaCl: 33 g
KI: 0.5 g
$K_2IrCl_6$ (0.01%): 2 ml Solutions (B) and (C) were simultaneously added to Solution (A) while stirring at a constant temperature over a period of 30 minutes to prepare an emulsion.

Solutions (B) and (C) were simultaneously added to Solution (A) while stirring at a constant temperature over a period of 30 minutes to prepare an emulsion. The thus-produced silver chloroiodobromide grains had a mean grain diameter of 0.40μ and were uniform in size.

After the addition was completed, cooling and desalting were carried out, and 25 g of gelatin was added to make the total volume 500 ml.

Gold and sulfur sensitizations were applied, and chemical ripening was performed at 60° C. for 60 minutes.

After the ripening was completed, 1-hydroxyethyl-5-{(3-(3-sulfopropyl)-2-benzooxazolinilidene}ethylidene-3-ethyl-2-thiohydantoin was added as a sensitizing dye to achieve spectral sensitization.

As a stabilizer, 4-hydroxy-6-methyl-1,3,3a,7-tetrazaindene was added, and in addition, to improve the dot quality, a polyethylene oxide compound represented by the formula as shown below was added.

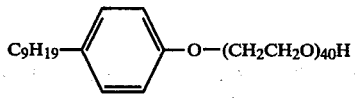

In addition, mucochromic acid was added as a hardener, and saponin as an extender.

The thus-prepared emulsion was coated on a polyethylene terephthalate support so that the amount of silver coated was 4.5 g/m². A gelatin layer was provided thereon as a protective layer to produce a light-sensitive material, Sample (7).

In the same manner as above except that in Solution (A) the tetra-substituted thiourea was replaced by 10 ml of a 1% aqueous solution of Compound (14), a light-sensitive material, Sample (8), was produced.

EXAMPLE 4

Grain formation was performed in the same manner as in Example 3 except that the tetra-substituted thiourea compound, Compound (10), was replaced by 15 ml of a 1% aqueous solution of an organic thioether compound represented by the formula:

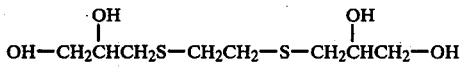

The thus-prepared silver halide grains has a mean grain diameter of 0.40μ, but were not uniform in size; the proportion of coarse grains was high.

Thereafter, in the same manner as in Example 3, a light-sensitive material, Sample (9), was produced.

COMPARATIVE EXAMPLE 4

The same solutions (A), (B), and (C) as in Example 3 except that the tetra-substituted thiourea compound, Compound (10), was removed were prepared. Using these solutions (A), (B), and (C), grain formation was performed while adjusting the temperature of addition thereof to such a temperature as to provide a mean grain diameter of 0.40μ.

Thereafter, in the same manner as in Example 3, a comparative light-sensitive material, Sample (10), was prepared.

COMPARATIVE EXAMPLE 5

In the same manner as in Example 3 except that $K_2IrCl_6$ was removed, a comparative light-sensitive material, Sample (11), was produced.

COMPARATIVE EXAMPLE 6

In the same manner as in Example 3 except that the thiourea compound, Compound (10), and $K_2IrCl_6$ were removed, a comparative light-sensitive material, Sample (12), was produced.

Samples (7) to (12) were each exposed by scanning with an argon laser beam, developed with Developer (I) having the formulation as described above, and Developer (II) having the formulation as described hereinafter, and fixed, rinsed with water, and dried by the usual procedure. The density was then measured.

Developer (II)

Sodium carbonate: 50 g
Formaldehyde-sodium hydrogensulfite adduct: 45 g
Potassium bromide: 2 g
Hydroquinone: 18 g
Sodium sulfite: 2 g
Water to make: 1 liter Each light-sensitive material was brought into close contact with a commercially available contact screen (150 line/inch), exposed in the same manner as above, developed with Developer (II) as described above, fixed, rinsed with water, and dried. Then, the dot quality was evaluated by observing with a loupe of 100 magnifications. The best dot quality was indicated by "5", and the worst by "1".

The results are shown in Table 2.

TABLE 2

| | 38° C., 20" Processing with Developer (I) | | 27° C., 1'40" Processing with Developer (II) | | Processing (27° C.) with Developer (II) Dot Quality | | |
|---|---|---|---|---|---|---|---|
| Run No. | Relative Sensitivity (fog + 1.5) | Strength Line Portion $\gamma$ | Relative Sensitivity (fog + 1.5) | $\overline{G}$ (Tangent at Concentration of 0.2–3.5 | 1'20" | 1'40" | 2' |
| Sample (7) | 258 | 4.7 | 468 | 8.7 | 4 | 5 | 4 |
| Sample (8) | 250 | 4.6 | 457 | 7.6 | 4 | 5 | 4 |
| Sample (9) | 270 | 4.3 | 504 | 6.8 | 4 | 4 | 3 |
| Sample (10) | 224 | 4.2 | 417 | 6.6 | 2 | 4 | 3 |
| Sample (11) | 126 | 3.5 | 158 | 5.8 | 3 | 4 | 3 |
| Sample (12) | 100 | 3.1 | 100 | 5.0 | 2 | 3 | 3 |

Note:
Samples (10) to (12): Comparative light-sensitive materials

The relative sensitivity was determined with that of Sample (12), a comparative light-sensitive material, as 100.

It can be seen from Table 2 that compared with Samples (10) to (12), comparative light-sensitive materials, Samples (3) and (4), light-sensitive materials of the invention, exhibit high sensitivity and provide high contrast when developed with either Developer (I) or (II).

While the invention has been described in detail and with reference to specific embodiments thereof, it will be apparent to one skilled in the art that various changes and modifications can be made therein without departing from the spirit and scope thereof.

What is claimed is:

1. Silver halide photographic emulsion having silver halide grains, comprising:

(a) silver chloride in an amount of 60 mol% or more;

(b) silver bromide in an amount of 40 mol% or less; and (c) silver iodide in an amount of 5 mol% or less, wherein the grains are formed in the presence of (i) a silver halide solvent, wherein said silver halide solvent is a tetra-substituted thiourea represented by the general formula:

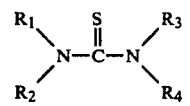

wherein $R_1$, $R_2$, $R_3$ and $R_4$ independently represent a substituted or unsubstituted alkyl group, an alkenyl group, or a substituted or unsubstituted aryl group, or wherein said $R_1$ and said $R_2$ or said $R_2$ and said $R_3$ or said $R_3$ and said $R_4$ combine together to form a 5- or 6-membered heterocyclic ring, and (ii) from $10^{-8}$ to $10^{-5}$ mole of a water-soluble iridium compound per mole of silver halide.

2. Silver halide photographic emulsion as claimed in claim 1, wherein $R_1$, $R_2$, $R_3$ and $R_4$ contain 30 carbon atoms or less.

3. Silver halide photographic emulsion as claimed in claim 2, wherein $R_1$ and $R_2$ or $R_2$ and $R_3$ or $R_3$ and $R_4$ combine together to form a 5- or 6-membered heterocyclic ring.

4. Silver halide photographic emulsion as claimed in claim 1, wherein the grains have a mean grain size within the range of 0.2 to 0.6$\mu$.

* * * * *